US010314381B1

(12) United States Patent
Silva et al.

(10) Patent No.: US 10,314,381 B1
(45) Date of Patent: Jun. 11, 2019

(54) HAIRCUTTING COLLAR, METHOD OF MAKING AND USING

(71) Applicant: Hanover Premium LLC, Reno, NV (US)

(72) Inventors: Joseph D Silva, Reno, NY (US); Bradley P Weber, Bel Aire, KS (US)

(73) Assignee: Hanover Premium LLC, Reno, NV (US)

( * ) Notice: Subject to any disclaimer, the term of this patent is extended or adjusted under 35 U.S.C. 154(b) by 47 days.

(21) Appl. No.: 15/640,515

(22) Filed: Jul. 1, 2017

(51) Int. Cl.
*A45D 44/08* (2006.01)
*A45D 44/00* (2006.01)

(52) U.S. Cl.
CPC ..... *A45D 44/08* (2013.01)

(58) Field of Classification Search
CPC ..... A45D 44/08; A45D 44/16; A41B 13/10; A41B 2400/52; A41D 13/04; A41D 2600/00; A41D 27/12; A41D 27/16
See application file for complete search history.

(56) References Cited

U.S. PATENT DOCUMENTS

| | | | | |
|---|---|---|---|---|
| 2,778,024 A | | 1/1957 | Randolph | |
| 4,139,912 A | * | 2/1979 | Thuaud | A45D 44/08 2/50 |
| 4,458,364 A | * | 7/1984 | Fenninger | A45D 44/08 2/50 |
| 4,980,927 A | * | 1/1991 | Wawiluk | A45D 44/08 2/129 |
| 5,054,124 A | * | 10/1991 | Darvas | A45D 44/08 2/174 |
| 5,438,112 A | | 10/1995 | Wong | |
| 5,572,740 A | * | 11/1996 | Geniesse | A45D 44/08 2/46 |
| 5,950,236 A | * | 9/1999 | Andrew | A45D 44/16 2/49.5 |

(Continued)

FOREIGN PATENT DOCUMENTS

| | | |
|---|---|---|
| CN | 2533710 Y | 4/2002 |
| CN | 201441063 U | 4/2010 |
| GB | 2334200 A | 8/1999 |

OTHER PUBLICATIONS

U.S. Appl. No. 29/609,581 to Silva et al. filed Jul. 1, 2017.

(Continued)

*Primary Examiner* — Robert H Muromoto, Jr.
(74) *Attorney, Agent, or Firm* — Carrie M. Stroup

(57) ABSTRACT

A re-useable haircutting collar that is water resistant to dripping liquids and hair particles to protect a user's clothing and skin. The collar is made from flexible silicone or latex of a shore rating of extra soft to soft, skin adherent, non-toxic, and is a ring-shaped sheet, with an inner edge, mid-section, and outer edge, and with two opposing ends that overlap. The ends are tightly self-adhering to each other; therefore, the collars do not require fasteners to secure the ends together, and can be easily adjusted to fit any neck size to form a tight, but comfortable water seal. The collar is also lightweight and bendable to lay about vertically against the base of a user's neck and angled along their collarbone. Different collars embodiments also comprise differences in the thickness along the collar width at the top surface to provide different levels of collar flexibility.

20 Claims, 9 Drawing Sheets

(56) References Cited

U.S. PATENT DOCUMENTS

| | | | | |
|---|---|---|---|---|
| 5,960,515 | A * | 10/1999 | Lu | A45D 24/32 119/600 |
| 5,996,119 | A | 12/1999 | Anderberg | |
| 6,094,744 | A * | 8/2000 | Dibenedetto | A45D 44/08 2/50 |
| 6,385,774 | B1 | 5/2002 | Rodgers | |
| 6,427,241 | B1 | 10/2002 | Manno | |
| 6,868,554 | B1 * | 3/2005 | Melvin | A45D 44/08 2/49.4 |
| 6,934,968 | B2 * | 8/2005 | Kurpis | A41B 13/10 2/49.1 |
| 7,080,413 | B1 * | 7/2006 | Schneider | A41D 27/16 2/50 |
| 7,788,735 | B1 * | 9/2010 | Foulks | A41D 13/04 2/50 |
| 7,941,868 | B1 | 5/2011 | Shaw | |
| 7,996,918 | B2 * | 8/2011 | Bish | A45D 44/08 2/50 |
| 2004/0049828 | A1 * | 3/2004 | Moses | A41B 13/10 2/50 |
| 2004/0139533 | A1 * | 7/2004 | Kurpis | A41B 13/10 2/468 |
| 2010/0205712 | A1 * | 8/2010 | Bish | A45D 44/08 2/50 |
| 2013/0019368 | A1 * | 1/2013 | Gray | A41B 13/10 2/48 |
| 2013/0171265 | A1 * | 7/2013 | Saxena | A61K 8/896 424/618 |
| 2015/0208787 | A1 * | 7/2015 | Matsuda | A45D 44/08 2/50 |
| 2015/0374102 | A1 * | 12/2015 | Velasquez, Jr. | A45D 44/08 2/50 |
| 2017/0007007 | A1 * | 1/2017 | Miyamoto | A45D 44/08 |
| 2018/0235350 | A1 * | 8/2018 | Engblom | A45D 44/08 |

OTHER PUBLICATIONS

The Denman Robbc Neckquard—photo of package.
Raylay Beauty and Cosmetic Collar manufactured by Alibaba.
Cutting collar. (srlohas.en.alibaba.com).
Luxor Pro Deluxe Weighted Cutting Collar Black—sold online at WalMart.
Office Action dated Aug. 7, 2018 in connection with U.S. Appl. No. 29/609,581.
Reference cited: "Sibel Black Magnetic Cutting Collar Hair/Salon Accessories Sameday Dispatch" Sep. 28, 2016, eBay.co.uk., site visited Aug. 1, 2018.
Reference cited: "Salon Cutting Collar Stylist Magnetic Silicone Barber Cape Hair Coloring Shawl Neck Shutter Doubtless Bay (gray)", Feb. 5, 2017, amazon.com, site visited Aug. 1, 2018.

* cited by examiner

HAIRCUTTING COLLAR, METHOD OF MAKING AND USING

FIELD OF THE DISCLOSURE

The present disclosure relates generally to the field of cosmetology, and more particularly to a re-useable haircutting collar, which is placed over a cape during hair treatments to prevent fluids and hair particles from slipping beneath the collar and cape, and onto a user's body and clothes.

BACKGROUND OF THE DISCLOSURE

Normally hair stylists and barbers place a cape around a customer's torso, legs and arms prior to washing, cutting, or otherwise styling the customer's hair, and secure the cape at the back of the customer's neck using fasteners, such as snaps, and at a tightness indicated by the customer as comfortable. Because the capes are loose fitting around the neck, it is not uncommon for cut hair particles and fluids to slip between the inner lining of the haircutting capes and cling to a user's clothes, or even to slip down inside of their clothes, causing an irritating sensation.

A thin, rectangular-shaped strip is often placed around the customer's neck, inside of the cape to protect against contracting infections by being in contact with a re-useable cape. The strips are made of disposable paper or plastic material that often pulls apart or loosens when wet. They then become ineffective in protecting the customer's neck, and in preventing fluids from dripping beneath the strips, and hair particles from falling between gaps that exist between the neck and the strips and the cape, and onto the customer's skin and clothes beneath the cape.

The prior art teaches various cutting collars made of paper or rubber or the like for use in lieu, or in conjunction with, the rectangular strips, where the collars require fasteners to secure the ends together, such as snaps, Velcro-like material, magnets, etc. Therefore, they are not able to be adjusted to fit any neck size and comfort level, but only neck sizes that the fasteners are spaced for, thus leaving a space for fluids and hair particles to fall into for in-between sized necks. When made of paper, the collars are not impervious to fluids soaking through the collar top surface and onto a customer's clothes. And when made of rubber or plastic, such as the Robbc® Neckquard by Denman and the collar by Raylay Beauty and Cosmetics (marketed by Alibaba™) the collars are often not able to make a tight seal with the customer's neck due to the inflexible nature and surface texture of the material, therefore hair particles and fluids can still fall and/or slide beneath the top of the cape and onto the customer's skin and clothes. Also, the inflexibility of these collars creates an uncomfortable fit for the user.

Thus, there remains a need for an improved re-useable haircutting collar that is able to protect a user's (i.e. customer's) clothing and body from wetness, stains and chemical damage, and clinging hair particles during hair treatments. The collar should also be easily bendable (e.g. up to ninety degrees) to cover both the user's neck (e.g. up to a vertical position) and collarbone (e.g. angled down to a horizontal position), and be adjustable to fit any size human adult and/or child neck. And the collar should comprise material that comfortably contours and/or adheres and/or loosely bonds to the user's skin without adverse side effects (e.g. suction marks, stretched skin, toxic or irritated skin, etc.) to form a tight or water-resistant seal able to block dripping fluids and cut hair from sliding and falling beneath the collar.

SUMMARY OF THE DISCLOSURE

The present disclosure comprises various embodiments of a re-useable haircutting collar that are normally worn over a haircutting cape, and around and loosely bonded, contoured, or adhered to a user's neck during hair treatments to create a water-resistant or impervious seal that prevents fluids and hair particles from sliding beneath the collar and the haircutting cape.

The various exemplified embodiments of the haircutting collar of the present disclosure are generally annular (ring) shaped, although other shapes (e.g. rectangular, square, etc. with a neck-shaped cutout) are readily apparent to the skilled artisan and with the scope of the claimed invention. The collar ends may also comprise a variety of shapes, such as curved, rectangular, or decorative shaped.

In one or more embodiments, that re-useable haircutting collar, comprises: a sheet of flexible, liquid-impervious rubber material, with a shore hardness rating of extra soft or soft, a center hole able to fit around a user's neck, and a collar width extendable between a user's neck base and a user's top collarbone. The collar further comprises: two opposing, overlapping and self-adhering collars ends; a top and a bottom surface; and an inner edge and an outer edge, and a bendable mid-section in-between the inner and outer edge. Generally, the collar has an inner radius at an inner edge from about 60 to 100 millimeters, and an outer radius at an outer edge from about 120 to 220 millimeters; and/or a collar width between about 75 to 95 millimeters.

In the collar of the various embodiments, the collar is colored or non-colored translucent, or colored or non-colored opaque, and the color is adjustable based upon the manufacturing processes well known to the skilled artisan.

The collar is able to bend along and within the mid-section, and able to be positioned encircling and loosely adhering to a user's neck substantially vertically at the collar inner edge, and atop of the user's collarbone at the outer edge at an angle or substantially horizontal.

And the collar is deployable by folding the collar ends in an overlapping manner to provide a water resistant or impervious seal between a user's neck and the collar able to prevent a liquid and a hair particles from sliding beneath the collar, and from the liquid soaking through the collar top and bottom surface.

The various embodiments of the collar disclosed herein further comprise differences in the thickness of the collar top surface along its width (i.e. radius) to create different levels of collar flexibility. In all embodiments, the collar is easily bendable along its width and length to cover and adhere to both the user's neck at the collar inner edge to the collar mid-section (vertical position), and to also cover and adhere the user's collarbone from the collar mid-section to the collar outer edge (angled downward or horizontal position from within about thirty to ninety degrees).

The collar material comprises one or more of: 1) condensation cured silicone; platinum cured silicone; silicone that is non-toxic or irritating on contact with human skin; or latex rubber material; and, 2) wherein the material comprises a hardness rating of one of the following types: Shore 0A to 30A; Shore 0B to 17B; Shore 0C to 9C; Shore 0D to 6D; Shore 0O to 42O, and Shore 20 OO to 70 OO; and/or 3) any combination thereof. In an embodiment, the collar comprises platinum cured silicone of Shore 2A, and an inner radius at an inner edge from about 60 to 100 millimeters, and an outer radius at an outer edge from about 145 to 185 millimeters, and/or a collar width of about 85 millimeters.

The thickness of the collar is between one-half millimeters to six millimeters, such as about one to three millimeters, constant, and/or increasing, along a collar width from the inner edge to the outer edge on the collar top surface.

In one embodiment illustrated in FIGS. 1-4 and 11A, the collar thickness increases at a constant rate from the collar inner edge to a mid-section that is located at about one-third of the collar width; and then the thickness is constant from the mid-section to the collar outer edge.

In another embodiment that is illustrated in FIGS. 5-7 and 11B, the collar has a constant thickness along its width.

In another embodiment that is illustrated in FIGS. 8-10 and 11C, the collar's thickness gradually increases at a constant rate from the collar inner edge to the collar outer edge.

The collar in all embodiments is made from non-toxic, safe, non-skin irritating material. The material comprises silicone or latex of a shore hardness rating of extra soft to soft, which makes the material flexible so that it easily wraps and bends around a user's neck and collarbone, while being lightweight and soft for the comfort of the user, especially when it is in direct contact with a user's skin. The material is self-adhering so that the collar ends may be repeatedly bound together, and then pulled apart without damaging the collar. And the material adheres to the user's skin, such as at the collar inner edge on the neck, to form an impervious barrier to fluids (hair dye, water, shampoo, etc.) and cut hair particles that drip or fall down the user's neck. The collar material is also impervious to absorbing fluids on the collar's top surface. And the collar is able to be released from the user's skin without damaging the user's skin.

The collar material is able to be cleaned with soap and water to remove hair particles, and then sanitized by: soaking, and or spraying, with a salon approved cleaning solution (e.g. Barbicide®); or autoclaved; or machine washed, in order for the collar to be repeatedly used due to its ability to withstand wear and tear.

The collar can be worn on top of a traditional haircutting cape that is draped to cover the user's torso.

Method of Use

The method of using a re-useable haircutting collar, generally comprises the following steps. First, the stylist provides the re-useable haircutting collar, a generally annular shaped rubber sheet of soft, flexible liquid-impervious material with: a two opposing, overlapping and self-adhering collars ends; a top and a bottom surface; and an inner edge and an outer edge, and a bendable mid-section in-between the inner and outer edge.

The second step comprises wrapping the collar around a user's neck, and placing one collar end against the user's neck, and laying the opposing collar end on top thereof, wherein the two collar ends securely self-adhere without requiring fasteners or pressure. The collar is able to prevent a hair particle or a liquid from entering beneath the collar inner edge because the collar bottom surface adheres to the user's exposed skin, and it prevents the liquid from soaking through the top and bottom surface of the collar and onto the user's skin and clothing.

The next step comprises removing the collar after the styling is complete by separating the collar ends, sanitizing the collar, air or heat drying the collar, and reapplying the collar to a second user.

It is a principal object of the present disclosure to provide a hair-cutting collar that creates a water resistant at the user's neck by loosely adhering or contouring, to the user's skin to prevent fluids and hair particles from sliding beneath the collar.

A further object of the present disclosure is to provide a hair-cutting collar that does not require fasteners to secure the collars ends together, thus making the collar adjustable to comfortably fit any human neck size.

A further object of the present disclosure is to provide a hair-cutting collar that is easily cleaned and durable from wear and tear following repeated uses.

These and other objects will be apparent to those skilled in the art.

BRIEF DESCRIPTION OF THE DRAWINGS

The novel features believed to be characteristic of the various embodiments of the present disclosure are set forth with particularity in the appended claims, and may best be understood by reference to the following detailed description when taken in connection with the accompanying drawings.

DETAILED DESCRIPTION OF EXEMPLARY EMBODIMENTS

With reference now to the drawings, FIGS. 1-12 depict three exemplary embodiments of a re-useable haircutting collar, generally referenced as 10 for the first embodiment, 20 for the second embodiment, and 30 for the third embodiment. The three exemplary embodiments disclosed herein have the same general annular or ring shape, with a center hole sized to fit a human neck, and with the primary difference being in the thickness of the collar top surface along the width (radius) from the collar inner edge to the collar outer edge (e.g. see FIGS. 11A-11C). It is noted, though, that one of skill in the art would readily know of other collar shapes comprising a neck-sized center hole (e.g. rectangular, oval, etc.) for use in the present invention.

Figure 1:
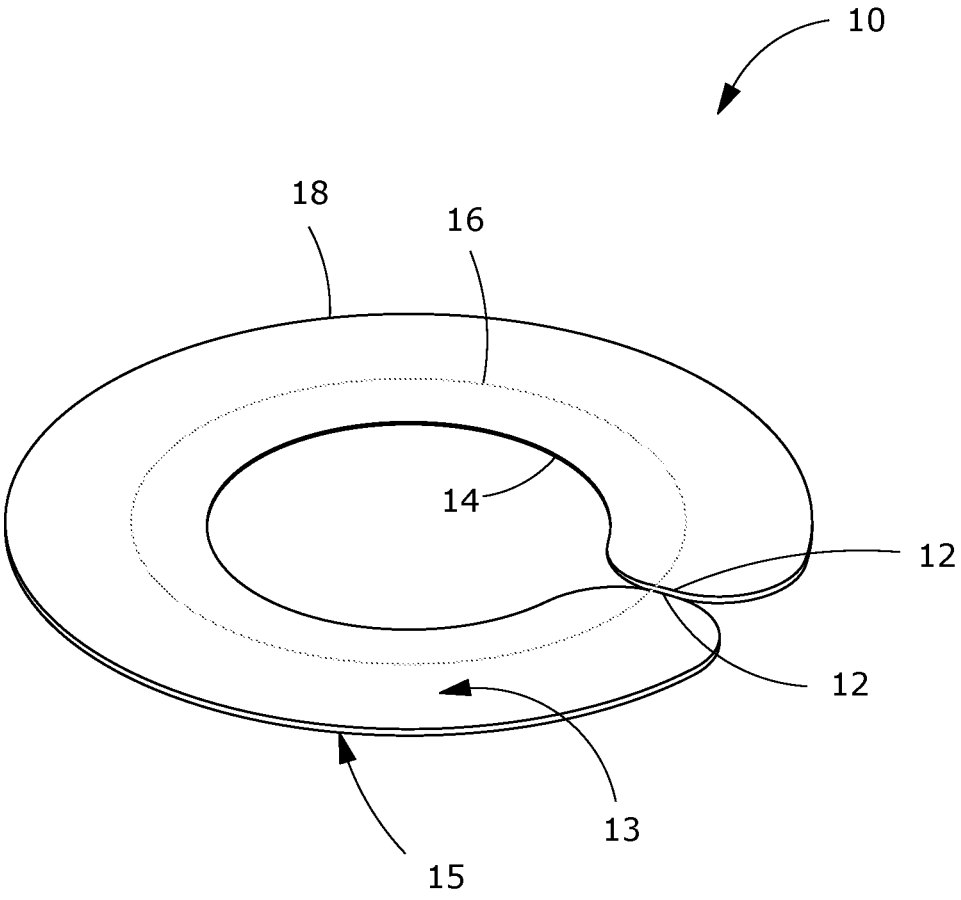
FIG. 1 is a top perspective view of the first embodiment of the haircutting collar comprising a ridge line.

As illustrated in FIGS. 1-12, collars 10, 20, and 30 comprise a generally annular or ring-shaped sheet of a soft, flexible liquid-impervious material with an inner edge at the inner radius (see collar 10—FIGS. 1-4, 14; collar 20—FIGS. 5-7, 24; collar 30—FIGS. 8-10, 34); and an outer edge at the outer radius (see collar 10—FIGS. 1-4, 18; collar 20—FIGS. 5-7, 28; and collar 30—FIGS. 8-10, 38), and a mid-section between the two (e.g. FIG. 1, 16).

Collar Size

The 95$^{th}$ percentile adult American male has a neck radius of about 67 mm, as measured from the center of the neck (i.e. the neck center) to the outer skin of the neck (see NASA, Man-Systems Integration Standards, Vol. 1, Section 3). The average female child ages 6-10 has a neck radius of about 41 mm (see Katz, S L et al., *BMC Pediatrics* 2014, 14:159). A range in the collar sizes produced must be determined in order to accommodate these ranges in common neck sizes. Since the friction based fastening technique utilized by this invention requires the collars ends to overlap and bond to each other based on friction and self-adhering material properties, all collars must have a radius and circumference somewhat larger than the neck of their intended wearer (e.g. about four to eight inches).

For all embodiments, the inner radius ranges from about 60 to 100 millimeters as measured from the center of the circle created by the collar (i.e. the collar center) as positioned in FIGS. 1-12 to the collar inner edge; and the outer radius ranges from about 120 to 220 millimeters as measured from the collar center to the collar outer edge. In the three exemplified embodiments of FIGS. 1-12, the inner radius is about 75 to 80 mm, and the outer radius is about 155-160 mm; and/or the collar width is about 75 to 95 millimeters, such as about 85 millimeters.

The collars may also be shaped into unisex sizes comprising, for example: child, adult normal, and adult extra-large.

The various embodiments of the annular shaped collar 10, 20, 30 have dimensions as disclosed in the Table 1 infra.

TABLE 1

| Collar Width | Range of Inner Radius (mm) | Range of Outer Radius (mm) |
|---|---|---|
| 60 mm | 60-100 mm | 120-160 mm |
| 65 mm | 60-100 mm | 125-165 mm |
| 70 mm | 60-100 mm | 130-170 mm |
| 75 mm | 60-100 mm | 135-175 mm |
| 80 mm | 60-100 mm | 140-180 mm |
| 85 mm | 60-100 mm | 145-185 mm |
| 90 mm | 60-100 mm | 150-190 mm |
| 95 mm | 60-100 mm | 155-195 mm |

TABLE 1-continued

| Collar Width | Range of Inner Radius (mm) | Range of Outer Radius (mm) |
|---|---|---|
| 100 mm | 60-100 mm | 160-200 mm |
| 105 mm | 60-100 mm | 165-205 mm |
| 110 mm | 60-100 mm | 170-210 mm |
| 115 mm | 60-100 mm | 175-215 mm |
| 120 mm | 60-100 mm | 180-220 mm |

The collar further comprises a top surface (see FIGS. 1-3, 13; FIGS. 5-7, 23; and FIGS. 8-10, 33); and a bottom surface that is in contact with the user's neck and clothing (see FIGS. 1-4, 15; FIGS. 5-7, 25; and FIGS. 8-10, 35).

Collar Thickness:

The thickness of the collar may be constant along its width (i.e. radius), and/or increasing from the inner edge to the outer edge (i.e. constant slope of increasing thickness, or constantly increasing slope to midsection, then constant thickness to outer edge). The collar thickness lies within one half to six millimeters, such as about one to three millimeters.

In the exemplified embodiment of FIGS. 1-4, 11A, and 12, the collar thickness increases on the top surface at a constant rate from the inner edge 14 to the mid-section 16, which in the exemplified embodiments of FIGS. 1-4 is at about 110 mm radius, or twenty millimeters width as measured from the inner edge 14. This may create a faint ridge line 16 on the top surface 13, but not on the bottom surface 15 (e.g. see FIG. 4). Then the collar thickness is constant from the mid-section ridge line 16 to the outer edge 18.

Figure 2:
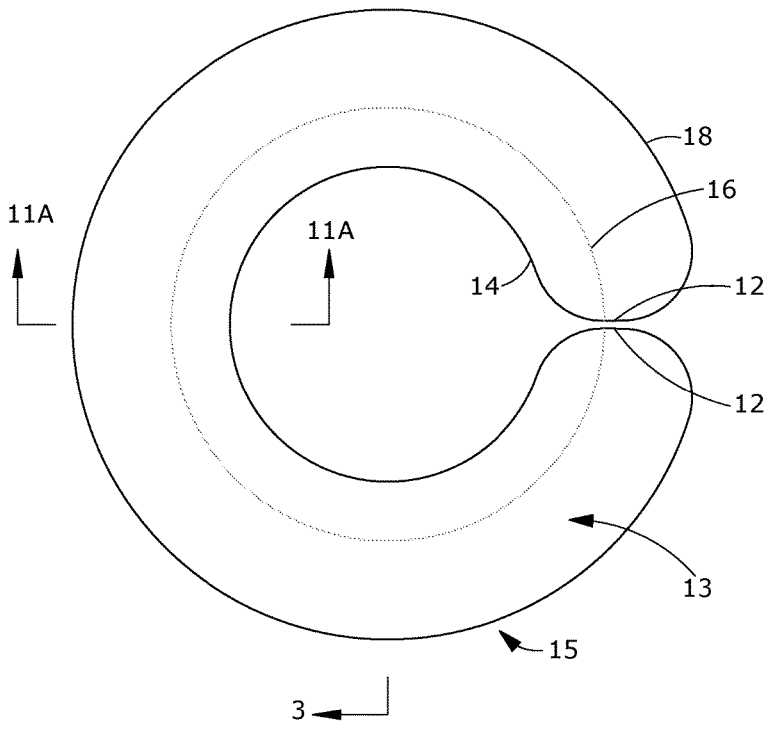
FIG. 2 is a top plan view of the first embodiment of the haircutting collar.
Figure 3:
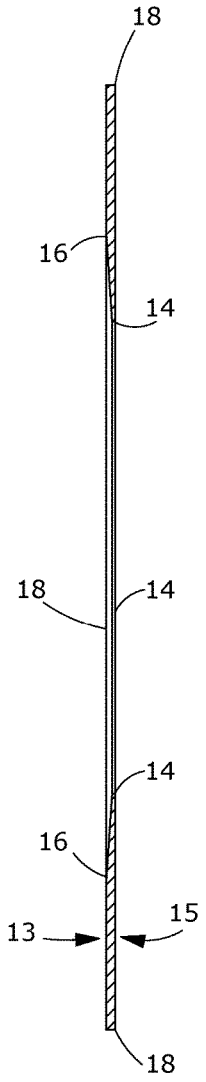
FIG. 3 is an enlarged cross-sectional view of the first embodiment of the haircutting collar, which taken along line 3-3 of FIG. 2.
Figure 4:
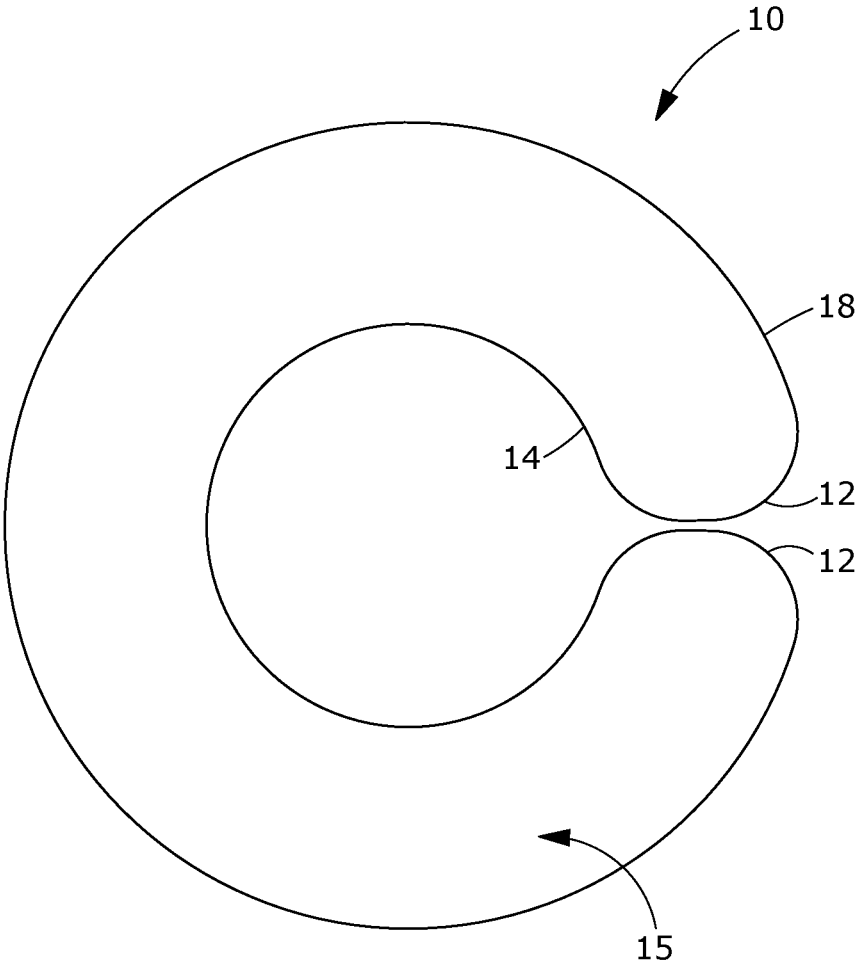
FIG. 4 is a bottom plan view of the first embodiment of the haircutting collar.

FIG. 3 provides a cross-sectional view of the cut line 3-3 of FIG. 2. The left side of FIG. 3 illustrates the top surface of the left side of the collar as positioned in FIG. 2, and it demonstrates the tapering upward of the collar thickness on the collar top surface 13 from the inner edge 14 to the mid-section 16, and then maintaining a constant thickness from mid-section 16 to the outer edge 18.

Figure 11A:
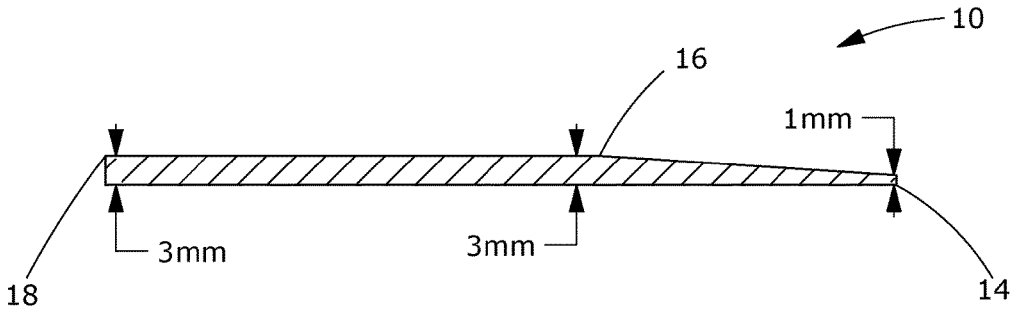
FIG. 11A is an enlarged cross-sectional view of the first embodiment taken along line 11A-11A of FIG. 2, and illustrating that the thickness of the haircutting collar increases from the inner collar edge to the mid-section, and then is uniform from the mid-section to the outer collar edge.

The collar thickness for FIGS. 1-4 is further illustrated in FIG. 11A, which is a cross-sectional view of the cut line 11A-11A of FIG. 2. FIG. 11A demonstrates an exemplary embodiment comprising collar 10 with a thickness of one millimeter at the inner edge 14 that increases at a constant rate to a thickness of three millimeters at the mid-section 16, and then maintains the same thickness of three millimeters to the outer edge 18.

Figure 5:
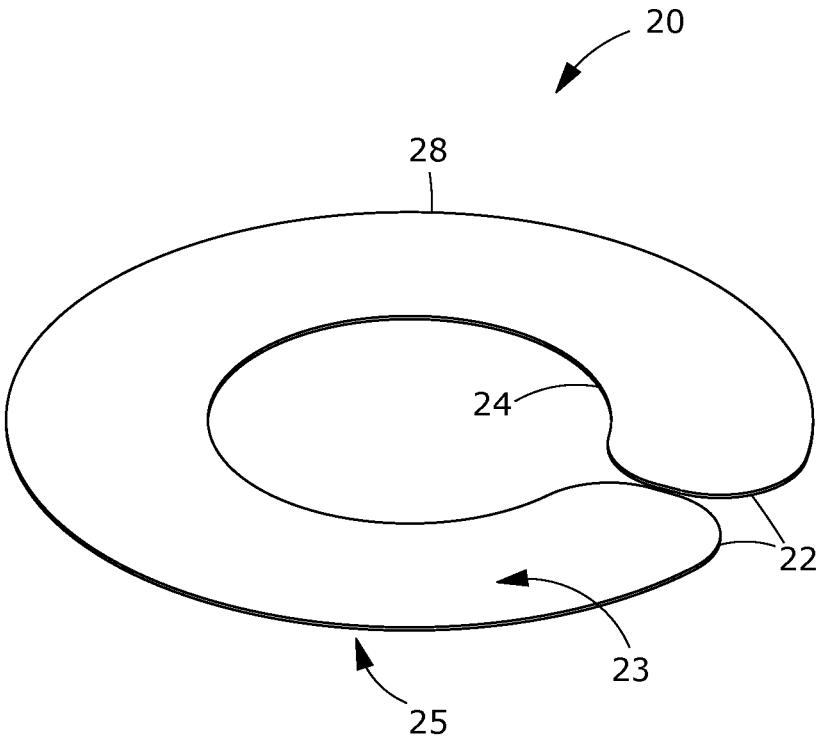
FIG. 5 is a top perspective view of the second embodiment of the haircutting collar comprising a constant thickness along the entire radius.
Figure 6:
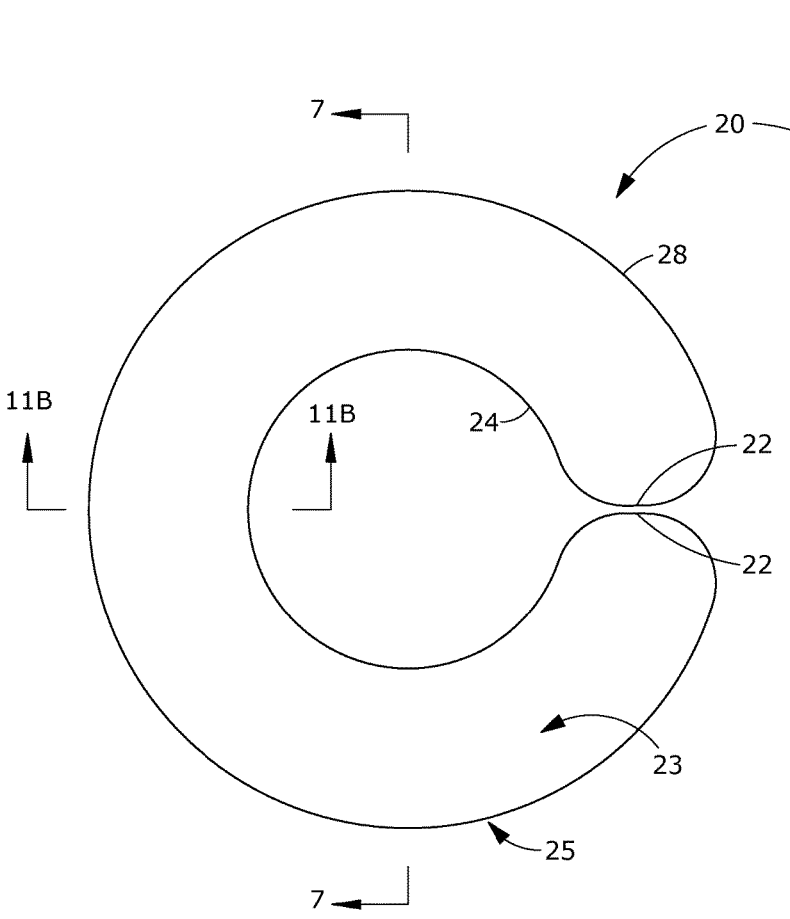
FIG. 6 is a top plan view of the second embodiment of the haircutting collar, and the bottom plan view being a mirror image thereof.
Figure 7:
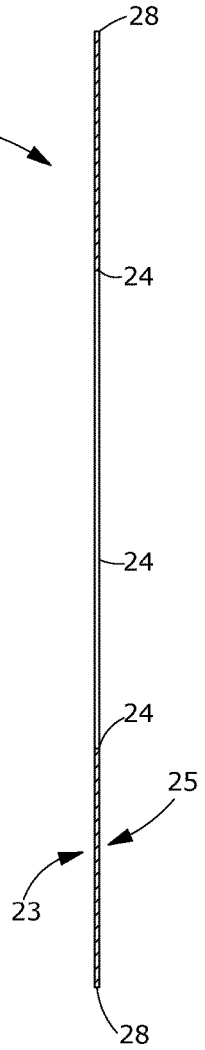
FIG. 7 is an enlarged cross-sectional view of the second embodiment of the haircutting collar, which taken along line 7-7 of FIG. 6.

In another embodiment that is exemplified in FIGS. 5-7 and 11B, the collar thickness is constant from the inner edge 24 to the outer edge 28. FIG. 7 provides a cross-sectional view of the cut line 7-7 of FIG. 6. The left side of FIG. 7 illustrates the left side of the collar as positioned in FIG. 6, and demonstrates the constant collar thickness from the inner edge 24 to the outer edge 28.

Figure 11B:
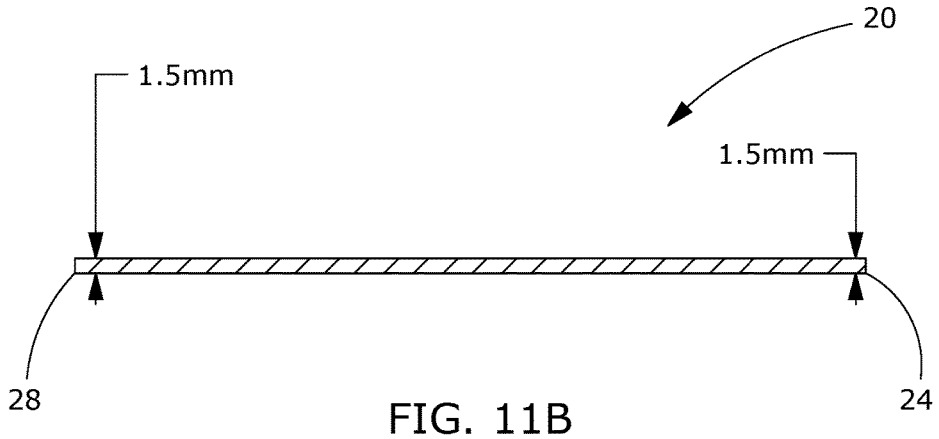
FIG. 11B is an enlarged cross-sectional view of the second embodiment taken along line 11B-11B of FIG. 6, and illustrating that the thickness of the haircutting collar is uniform from the inner collar edge to the outer collar edge.

And the collar thickness for FIGS. 5-7 is further illustrated in FIG. 11B, which is a cross-sectional view of the cut line 11B-11B of FIG. 6. FIG. 11B demonstrates an exemplary embodiment comprising collar 20 with a constant thickness of one and a half millimeters from the inner edge 24 to the outer edge 28.

Figure 8:
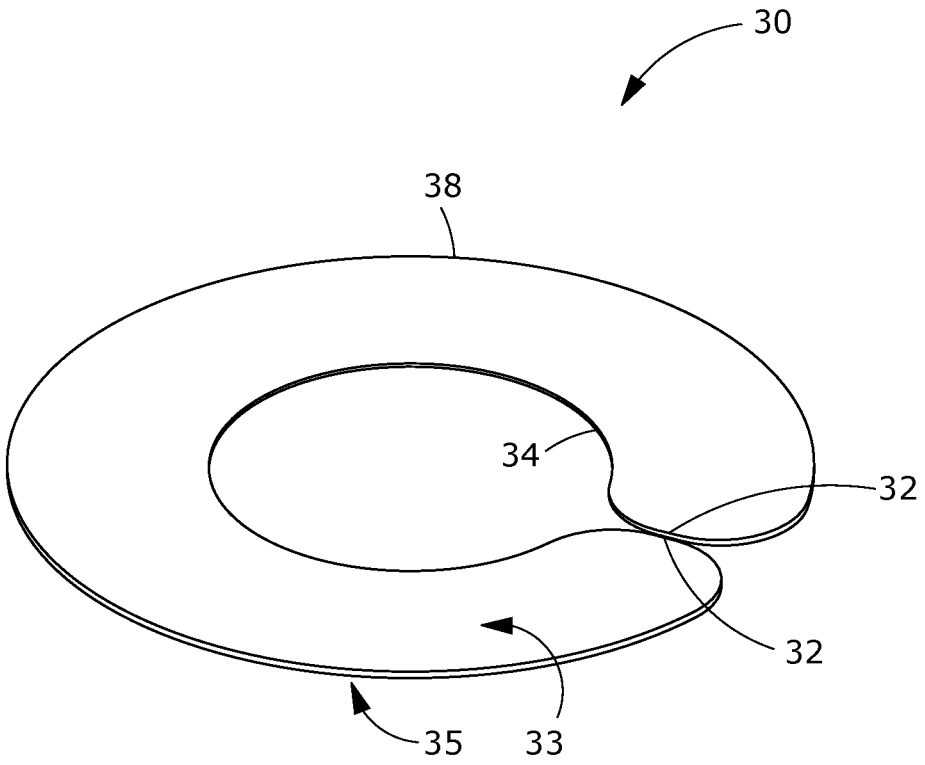
FIG. 8 is a top perspective view of a third embodiment of the haircutting collar.
Figure 9:
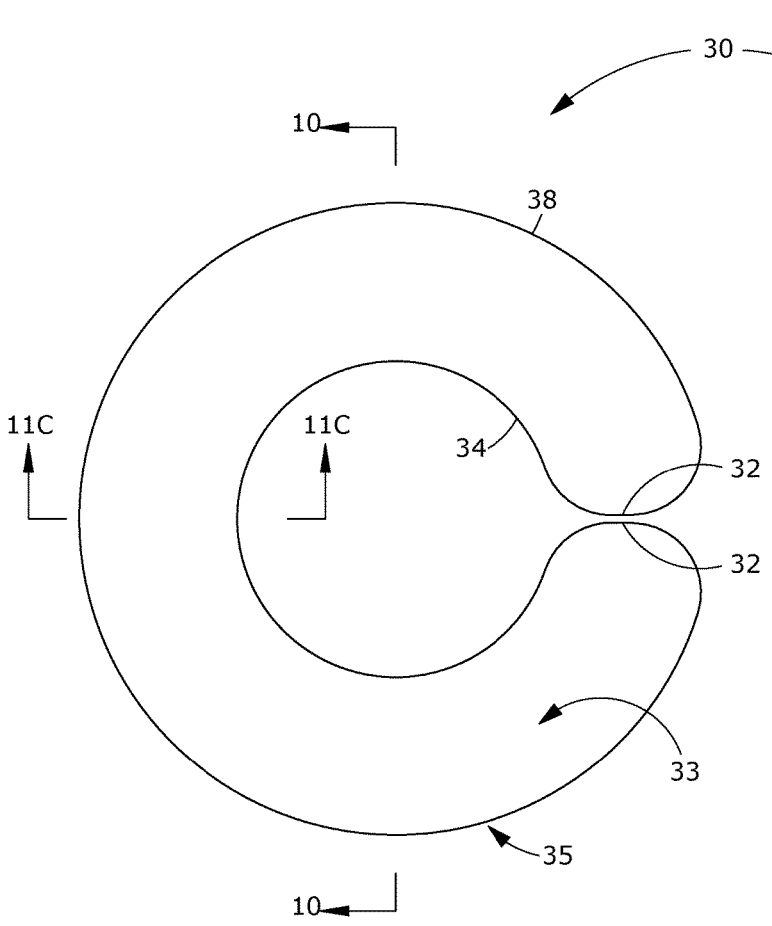
FIG. 9 is a top plan view, the bottom plan view being a mirror image thereof.
Figure 10:
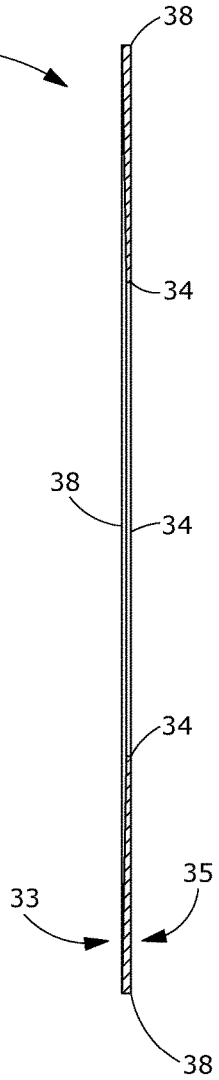
FIG. 10 is an enlarged cross-sectional view taken along line 10-10 of FIG. 9.

In another embodiment that is exemplified in FIGS. 8-10 and 11C, the collar thickness increases at a constant rate from the collar inner edge 34 to the collar outer edge 38. FIG. 10 provides a cross-sectional view of the cut line 10-10 of FIG. 9. The left side of FIG. 10 illustrates the top surface of the left side of the collar as positioned in FIG. 9, and it demonstrates that the collar thickness increases at a constant rate from the inner edge 34 to the outer edge 38.

Figure 11C:
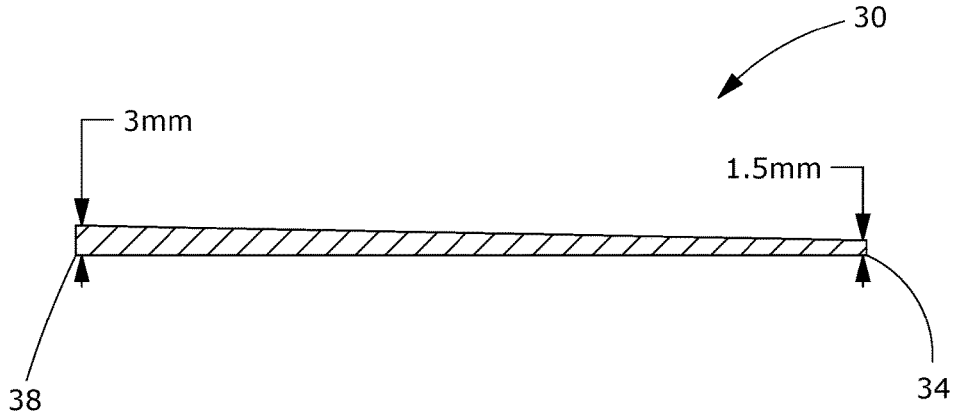
FIG. 11C is an enlarged cross-sectional view of the third embodiment taken along line 11C-11C of FIG. 9, and illustrating that the thickness of the haircutting collar gradually increases from the inner collar edge to the outer collar edge.

And the collar thickness for FIGS. 8-10 is further illustrated in FIG. 11C, which is a cross-sectional view of the cut line 11C-11C of FIG. 9. FIG. 11C demonstrates an exemplary embodiment comprising collar 30 with a thickness of one and a half millimeters at the inner edge 34 that increases at a constant rate to a thickness of three millimeters at the outer edge 38.

Collar Ends:

the collar further comprises two opposing ends that overlap in a self-adhering manner due to the material properties of the collar. And while the ends self-adhere in a strong bond, they are easily pulled apart without damaging the collar or the user's skin. The collar ends may comprise a variety of shapes, such as the exemplified curved ends (e.g. see FIGS. 1-2, 4, ends 12; FIGS. 5-6, ends 22; FIGS. 8-9, ends 32). Or the collar ends may be rectangular-shaped, or a decorative shape, as long as the ends are long enough to be securely self-adhering.

Because the collar ends strongly bond together, then the collars of the present disclosure do not require additional fasteners to secure the ends of the collar together, such as snaps, Velcro-like tabs, magnets, etc. that the prior art requires. And because the collar ends are not limited by the use of fasteners with neck size settings, then the collars of the present disclosure are able to fit any size human neck and at a tightness that is comfortable for the user while still being able to prevent any liquids or hair particles from slipping beneath the collar.

Figure 12:
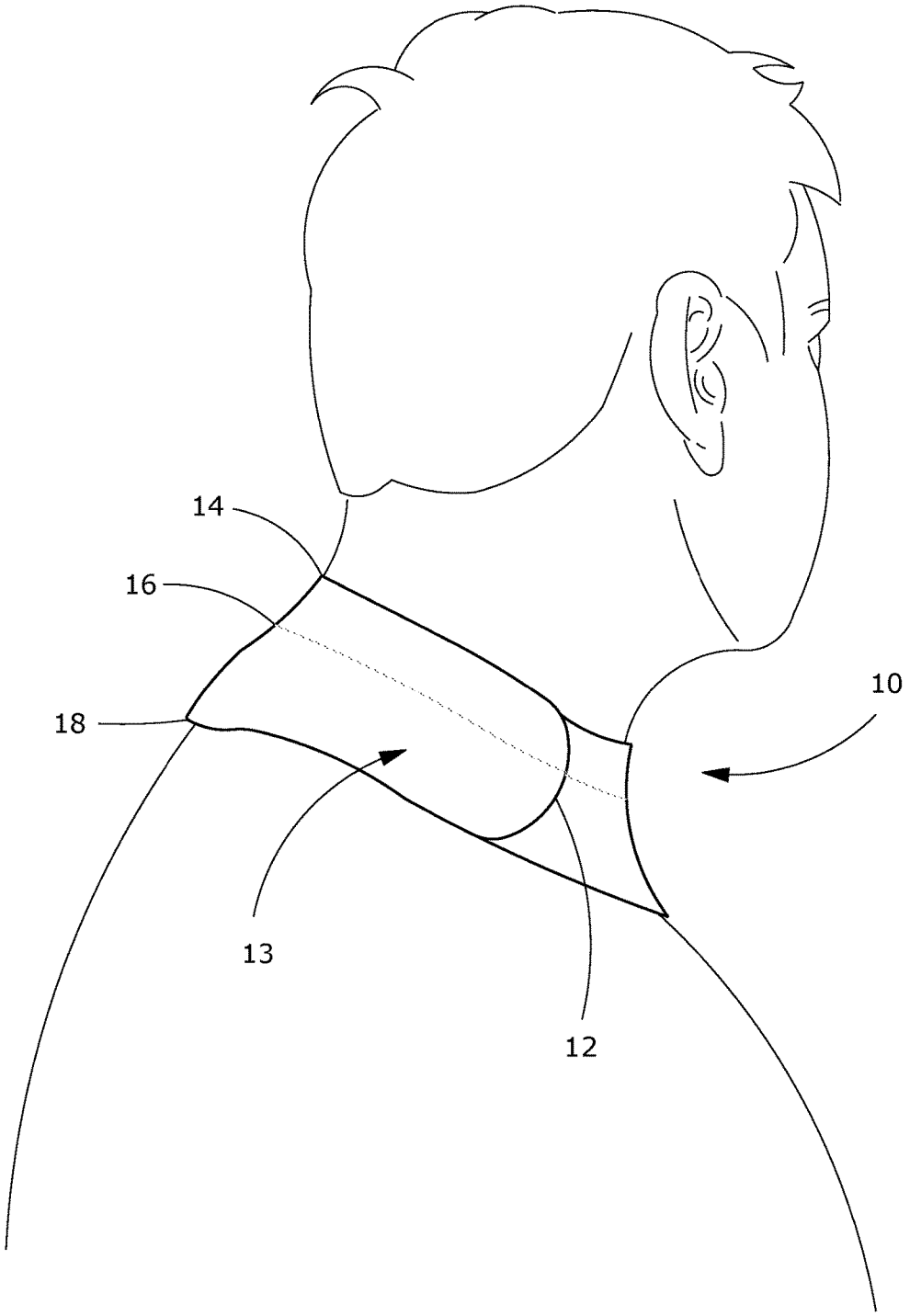
FIG. 12 is perspective, side view of the first embodiment of the haircutting collar in a closed position and demonstrating its method of use by wrapping it around the customer's neck and on top of a hairdressing cape to seal any fluids from penetrating through the collar, and any fluids and particles from dripping-sliding under the cape and onto or under the customer's clothes.

And as exemplified in FIG. 12, when the collar is in position around the user's neck, the collar ends 12 may be positioned to overlap near or slightly in front of the user's shoulder after laying the middle of the collar on the user's chest-throat and wrapping the collar ends 12 around the back of the user's neck. The location of the collar ends overlapping can widely vary, and is dependent on: if the collar was mounted from the front or back or side, the circumference of the user's neck and collar, and how tight the collar is wrapped.

Materials and Methods of Making

The method of making the collar of the various embodiments disclosed herein comprises the use of a soft, flexible, fluid impervious, non-porous, self-adhering material, safe for use in contact with human skin, such as: cured silicone rubber because of its anti-microbial properties; latex rubber material; or platinum cured silicone rubber because of its known safety for skin and food use.

It is well known by the skilled artisan that rubber materials are given a hardness rating that comprises a shore rating of: extra soft, soft, medium or hard, or the like. The material of the re-useable haircutting collar of the various embodiments disclosed herein comprise only an extra soft or soft shore hardness rating that is safe to use in contact with human skin. Examples of materials include one or more of: condensation cured silicone; platinum cured silicone; silicone that is non-toxic or irritating on contact with human skin; or latex rubber material; and, wherein the material comprises an extra soft to soft hardness rating of one of the following types: Shore 0A to 30A; Shore 0B to 17B; Shore 0C to 9C; Shore 0D to 6D; Shore 0O to 42O, and Shore 20 OO to 70 OO; or any combination thereof.

In one embodiment, the collars are fabricated from thin sheets of platinum cured silicone of about Shore 2A. They may also be packaged for individual dispensing as needed.

Individual collars may be produced by creating collar molds made from solid material such as aluminum, stainless steel, or acrylic. The acrylic mold is carved out using computer numerical control (CNC) milling to reproduce a cavity with the size and shape of the desired collar, such that the diameter and depth of the mold cavity (e.g. substantially ring or annular shaped) equals the width, length, and thickness of the collar.

In an embodiment, liquid platinum and liquid silicone are co-mixed to produce a solid platinum cured silicone of Shore 30A or softer (e.g. about Shore 2A or the like). The liquids are pre-mixed and then poured or injected into the mold cavity, and the top surface is scraped to a be level. The silicone is then cured to a solid composition, removed from the mold, and trimmed.

The top surface of the collar may also be embossed, debossed or otherwise labelled with a logo or trademark of the manufacturer or owner of the collar. The label may be incorporated into the mold. For example, the bottom surface of the mold is the top surface of the collar, and a logo or trademark is carved into the mold (embossed) or extends out from the mold (debossed).

The collar may also be: colored or non-colored translucent; or colored or non-colored opaque. One of skill in the art would know of ways to color the rubber doing the collar manufacturing and curing process. In an embodiment disclosed herein, liquid pigment is added when mixing the platinum catalyst (e.g. pure platinum suspended in liquid carrier) and the silicone liquid.

Exemplification: Platinum Cured Silicone

Steps of Manufacturing—Small and Large Scale

Creating a Mold: For individual-manual processes in small scale production of the collar, the user creates a mold from 0.25" to 0.5" thick cast acrylic sheets that are at least 2" wider and longer than the outer diameter of the collar. Using CNC carving or milling machine (e.g. Inventible X-Carve CNC Carving Machine™ 1000 mm×1000 mm), the user mills out the pocket that will create the mold cavity for the collar. The user then hand polishes and cleans up imperfections in the mold once milling is completed.

For creating a mold for large-scale production of the collar, a stainless-steel mold is created comprising two parts (e.g. top and bottom). Channels are also carved into the mold for the silicone to be injected and for air to escape.

Mixing Platinum and Silicone:

Steps for producing platinum cured silicone are well known in the art (e.g. U.S. Pat. No. 5,438,112, issued Aug. 1, 1995 to Wong and entitled "Methods of Curing Silicone Resin", which is incorporated herein by reference in its entirety). In small and large-scale production, the user measures equal parts by weight or volume of liquid silicone base and a platinum catalyst hardener (e.g. Smooth-On Dragon Skin FX Pro 2A™). The user also measures appropriate pigmenting material for the desired color mix and intensity (e.g. Smooth-On Silc Pig Silicone Pigmenting Set™). Then the user combines the base, catalyst, and pigment into a container four times the required volume. The user stirs the mixture very thoroughly until it is completely mixed to an even color.

Degassing Silicone:

In small and large-scale production, the user places the container with the platinum silicone mixture in a vacuum degassing chamber, and de-gases the mixture at 29 inHg vacuum pressure for 30-45 seconds. This will cause most of the entrapped air to expand into large bubbles, which then pop and release the entrapped air. The user then releases the vacuum and removes the platinum silicone container.

Pouring Versus Injecting Platinum Silicone Mixture:

In small scale manufacturing, the user pours the platinum silicone mixture into the clean mold that was created in the first step, thus producing a thin consistent stream from a height of about twelve inches. The user pours in one fixed position and allows the platinum silicone mixture to flow throughout and across the mold; and continues to fill the mold until it is filled completely and a slight excess of the mixture is protruding from the mold surface. The user then moves a straight edge scraper across the top surface of the mold in order to remove the excess mixture, and so that the top surface of the mixture is parallel, aligned with the top surface of the mold.

In large scale manufacturing, the degassed platinum silicone mixture is injected under high pressure such that it fills the cavity created between the two joined halves of the mold, and in automated processes.

Mixture Curing to Solid Collar:

In small scale manufacturing, the curing is done by allowing the mixture to set to a solid at room temperature, e.g. about forty minutes. In large scale manufacturing, high pressure is maintained and heat is applied to speed up the curing process, and by using methods well known in manufacturing rubber curing operations.

Removing and Trimming the Solid Collar:

In small scale manufacturing, the user carefully peels the solid collar away from the acrylic mold, inspects for defects and trims away any excess platinum cured silicone from the collar inner and outer edges. In large scale manufacturing, the mold is opened and the solid collar is ejected (e.g. automatedly). The collar is cleaned and excess (e.g. mold flashing) is trimmed using automated methods well known to one of skill in the art, such as liquid nitrogen tumbling process.

Method of Use

The various embodiments of the haircutting collar of the present disclosure can be used with or without a haircutting cape to protect a user's clothes and skin when the user's hair is washed, dyed, and/or cut; but use with a cape is recommended. When a haircutting cape is used as illustrated in FIG. 12, then the method of use of haircutting collar comprises the following steps that may be easily modified or re-ordered by the artisan to prevent liquids and/or hair particles from slipping into a user's clothing when the user's hair is being styled. In step one, the haircutting cape is draped over a user to cover both their clothing and exposed skin over their arms and hands and legs; and it is secured at the back of the user's neck. Preferably, the user is in a sitting position in a stylist's chair.

In step two, the stylist grabs both collar ends 12, one in each hand, to pull and expand the collar into a fully opened, extended position. Because of the flexibility of the collar material, the stylist can significantly pull the collar ends apart and deform the shape of the collar from a ring to a substantially rectangular-linear shape.

In step three, the collar is wrapped around the user's neck front-to-back, and comprises the stylist lowering the collar over the user's head and placing the center section (i.e. half way point between right and left side of collar) onto the user's throat near the larynx at the collar inner edge and extending onto the user's chest-collarbone at the collar outer edge. The stylist then wraps the ends of the collar over the user's shoulders, e.g. the left collar end over the right shoulder and the right collar end over the left shoulder. The top collar edge will automatically adhere or contour to the user's exposed neck upon contact, so the stylist should ensure that the collar is wrapped tightly enough for this to occur.

Alternatively, in step three the collar wrapping is done back-to-front, and comprises the collar center section mounted against the back of the user's neck and then collar ends wrapped around to the front of the user's neck to create a tighter fit then wrapping from front-to-back. The stylist wraps the ends of the collar over the user's shoulders, e.g. the left collar end over the left shoulder and the right collar end over the right shoulder. This rear position mounting may provide a tighter seal than as described supra for a front position mounting. In either scenario, the collar ends will overlap about six to eight inches, although the skilled artisan would readily know how to adjust the collar length overlap.

In step four, the stylist places one collar end 12, 22, or 32 against the back of the user's neck, and lays the opposing collar end on top of it. The two collar ends will then form a bond, and self-adhere to each other, and to the user's exposed neck skin, due to the material properties of the collar.

The material properties of the collar's rubber prevent any type of liquid from soaking through the top and bottom surface of the collar and onto the user's skin and clothing.

The tight fit of the collar around the user's neck may be adjusted to the user's comfort level and neck size by the stylist pulling the collar ends 12 gently apart without damaging them, and repositioning them as directed by the user, and then overlaying ends 12 again, wherein they will automatically self-adhere. The fit of the collar should be tight enough, while comfortable, to retard, diminish, or prevent any liquid and hair particles from slipping or dripping down the user's neck and under the cape.

And in using collar 10, 20, 30, the collar width from the inner edge to the mid-section is substantially vertical against the user's neck and gently adhering or contouring to it, while the collar width from the mid-section to the collar outer edge is substantially angled at about: a 30 to a 90-degree angle; a 40 to an 80-degree angle, or a 45- e.g. a forty-five-degree angle; and so as to cover the user's shoulders and collarbone. The collar is able to deform along the mid-section length because of the material properties of the collar rubber render it flexible in all directions.

In step five, the collar is removed after the hair styling is complete, and by the stylist gently pulling the ends 12 of the collar apart. Due to the durability of the collar material, the collar ends 12 are not damaged when separated, nor do they lose their ability to self-adhere over repeated uses of the collar. The collar is then cleaned with soap and water to remove hair particles, and then sanitized by soaking in a bucket or sink or spraying on a cleaning solution that is approved for use in salons to sterilize haircutting utensils after each customer. Types of sanitizing solutions are well known to the skilled artisan, and comprise by way of non-limiting examples: Barbicide®, alcohol based solutions, etc. The collar is then aired dried, or dried via the use of a blow dryer, and is ready for re-application to another user's neck/shoulders.

Table 2, supra, provides alternative methods of sanitizing the collars. It is noted, though, that each state and local region is subject to laws and regulations pertaining to the operation of salons and barber shops that dictate methods of cleaning haircutting utensils, which are applicable to the res-useable collars disclosed herein.

TABLE 2

| Methods of Sanitizing Collars | |
|---|---|
| Method A - Barbicide ® Liquid | |
| 1. | Immerse in Barbicide ® for 10 minutes. |
| 2. | Pat dry with clean towel. |
| 3. | Allow to naturally air dry or dry thoroughly with a hairdryer. |
| Method B - Barbicide ® Wipes | |
| 1. | Wet all surfaces of collar with a newly opened Barbicide ® wipe. |
| 2. | Keep surface wet with Barbicide ® for 2 minutes (may require additional wetting). |
| 3. | Pat dry with clean towel. |
| 4. | Allow to naturally air dry or dry thoroughly with a hairdryer. |
| Method C - Autoclave | |
| 1. | Place at least one collar in autoclave in single layer. |
| 2. | Maintain 121° C. and 15 psi for at least 30 minutes. |
| 3. | Allow to cool to room temperature before using the collar in contact with human skin. |
| Method D - Machine Wash | |
| 1. | Place at least one collar in a mesh containment bag. |
| 2. | Place in washing machine on high heat with disinfecting detergent (e.g. bleach). |
| 3. | Remove collars and allow to air dry or dry with a hair dryer (do not dry in machine dryer as they will pick up lint as they dry). |

CONCLUSION

The product names used in this document are for identification purposes only. All trademarks and registered trademarks are the property of their respective owners.

It is also apparent that the skilled artisan could easily modify the shapes of the collars to achieve an equivalent level of water imperviousness as disclosed herein. Although various features of the invention may be described in the context of a single embodiment, the features may also be provided separately or in any suitable combination. Conversely, although the invention may be described herein in the context of separate embodiments for clarity, the invention may also be implemented in a single embodiment.

As used herein, the term "about" refers to plus or minus five percent of the stated value.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions. As used herein, the term "substantial" and "substantially" refers to what is easily recognizable to one of ordinary skill in the art.

It is to be understood that the phraseology and terminology employed herein is not to be construed as limiting and are for descriptive purpose only. It is to be understood that the details set forth herein do not construe a limitation to an application of the invention. Furthermore, it is to be understood that the invention can be carried out or practiced in various ways and that the invention can be implemented in embodiments other than the ones outlined in the description.

It is to be understood that the terms "including", "comprising", "consisting" and grammatical variants thereof do not preclude the addition of one or more components, features, steps, or integers or groups thereof and that the terms are to be construed as specifying components, features, steps or integers.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. A re-useable haircutting collar, comprising:

an annular shaped sheet of flexible, liquid-impervious silicone rubber material, with a shore hardness rating of extra soft or soft comprising condensation cured silicone, or platinum cured silicone, that is non-toxic or irritating on contact with human skin, and with a hardness rating of one of the following types: Shore 0A to 30A; Shore 0B to 17B; Shore 0C to 9C; Shore 0D to 6D; Shore 0O to 42O, and Shore 20 OO to 70 OO, or any combination thereof, and a center hole able to fit around a user's neck, and a collar width extendable between a user's neck base and a user's collarbone, further comprising: a two opposing, overlapping and self-adhering without fasteners collars ends; a top and a bottom surface; and an inner edge and an outer edge, and a bendable mid-section in-between the inner and outer edge;

wherein the collar is colored or non-colored translucent, or colored or non-colored opaque;

wherein a thickness of the collar is between one-half millimeters to six millimeters, constant, and/or increasing, along a collar width from the inner edge to the outer edge on the collar top surface;

wherein the collar is able to bend along and within the mid-section, and able to be positioned encircling and adhering to a user's neck at the collar inner edge, and atop of the user's collarbone at the outer edge; and whereby the collar is deployable by stretching, folding and securing without fasteners said collar ends in an overlapping manner tightly to conform to a user's neck without adhering to the neck to provide a water resistant or impervious seal between a user's neck and the collar able to prevent a liquid and a hair particles from sliding beneath the collar, and from the liquid soaking through the collar top and bottom surface, and upon removal the collar resumes its original shape for reuse.

2. The re-useable haircutting collar of claim 1, wherein when the collar is deployed, the collar inner edge to the collar mid-section is in about a vertical position while adhering to the user's neck; and the collar mid-section to the collar outer edge lays at about thirty to ninety-degree angle along a user's collarbone.

3. The re-useable haircutting collar of claim 1, the collar thickness on the collar top surface increases at a constant rate from the inner edge to the mid-section, and the thickness is constant from the mid-section to the outer edge.

4. The re-useable haircutting collar of claim 3, wherein the thickness at the inner edge is about one millimeter and increases at a constant rate to a thickness of about three millimeters at the mid-section ridge line.

5. The re-useable haircutting collar of claim 1, wherein the collar thickness is constant from the inner edge to the outer edge, and about one and a half millimeters thickness.

6. The re-useable haircutting collar of claim 1, wherein the collar thickness is about one and a half millimeters at the inner edge and about three millimeters at the outer edge, and the collar thickness increases on the collar top surface at a constant rate from the inner edge to the outer edge.

7. The re-useable haircutting collar of claim 1, wherein the collar is durable against wear and tear by repeated uses, and is able to be cleaned by soaking in, or sprayed with, a salon approved cleaning solution.

8. The re-useable haircutting collar of claim 1, wherein the collar ends are curved, or rectangular, shaped, and are tightly self-adhering without requiring fasteners to secure the ends together, and are adjustable to fit almost any human neck size to form a tight, comfortable seal to the user's neck.

9. The re-useable haircutting collar of claim 1, wherein the collar is generally annular shaped with an inner radius at an inner edge from about 60 to 100 millimeters, and an outer radius at an outer edge from about 120 to 220 millimeters, and/or a collar width between about 75 to 95 millimeters.

10. The re-useable haircutting collar of claim 9, wherein the collar comprises platinum cured silicone of Shore 2A, and an inner radius at an inner edge from about 60 to 100 millimeters, and an outer radius at an outer edge from about 145 to 185 millimeters, and/or a collar width about 85 millimeters.

11. A re-useable haircutting collar, comprising:

a generally annular shaped sheet of flexible, liquid-impervious: condensation cured silicone, or platinum cured silicone, non-toxic, non-irritating and non-adherent on contact with human skin, and with an extra soft to soft shore hardness rating of one of the following types: Shore 0A to 30A; Shore 0B to 17B; Shore 0C to 9C; Shore 0D to 6D; Shore 0O to 42O, and Shore 20 OO to 70 OO, or any combination thereof, and further comprising:

a two opposing, overlapping and self-adhering curved collars ends; a top and a bottom surface; and an inner edge and an outer edge, and a bendable mid-section in-between the inner and outer edge;

wherein the generally annular shaped sheet has an inner radius at an inner edge from about 60 to 100 millimeters, and an outer radius at an outer edge from about 120 to 220 millimeters, and/or a collar width between about 75 to 95 millimeters;

wherein a thickness of the collar is constant, and/or increasing, along a collar width spanning from the inner edge to the outer edge on the collar top surface, and ranging from about one-half to six millimeters; and, wherein the generally annular shaped sheet is able to be bended along and within the mid-section and positioned encircling and adhering to a user's neck at the inner edge, and atop of the user's collarbone at the outer edge to provide an impervious seal between a user's neck and the collar able to prevent a liquid and a hair particles from sliding beneath the collar, and from liquids soaking through the collar top and bottom surface, and upon removal the collar resumes its original shape for reuse.

12. The re-useable haircutting collar of claim 11, wherein the collar thickness on the collar top surface increases at a constant rate from about one millimeter at the collar inner edge to about three millimeters at mid-section, and the thickness is about three millimeters from the mid-section to the outer edge; and wherein the mid-section is located a distance of about one-third of a collar width from the collar inner edge.

13. The re-useable haircutting collar of claim 11, wherein the collar thickness is about one and a half millimeters thickness from the inner edge to the outer edge.

14. The re-useable haircutting collar of claim 11, wherein the collar thickness is about one and a half millimeters at the inner edge and about three millimeters at the outer edge, and the collar thickness increases on the collar top surface at a constant rate from the inner edge to the outer edge.

15. The re-useable haircutting collar of claim 11, comprises an inner radius at an inner edge from about 60 to 100 millimeters, and an outer radius at an outer edge from about 145 to 185 millimeters, and/or a collar width of about 85 millimeters.

16. The re-useable haircutting collar of claim 15, wherein the collar comprises platinum cured silicone of about Shore 2A, and the collar is colored or non-colored translucent, or colored or non-colored opaque.

17. A method of using a re-useable haircutting collar, the steps comprising:

providing a re-useable haircutting collar, comprising, a generally annular shaped silicone rubber sheet of soft, flexible liquid-impervious material, non-toxic, non-irritating, and non-adherent on contact with human skin, and with a hardness rating of one of the following types: Shore 0A to 30A; Shore 0B to 17B; Shore 0C to 9C; Shore 0D to 6D; Shore 0O to 42O, and Shore 20 OO to 70 OO, or any combination thereof, and with: a two opposing, overlapping and self-adhering collars ends; a top and a bottom surface; and an inner edge and an outer edge, and a bendable mid-section in-between the inner and outer edge;

wherein the collar has an inner radius at an inner edge from about 60 to 100 millimeters, and an outer radius at an outer edge from about 120 to 220 millimeters; and/or a collar width between about 75 to 95 millimeters;

wrapping the collar around a user's neck, and placing one collar end against the user's neck, and laying the opposing collar end on top thereof, wherein the two collar ends securely self-adhere without requiring fasteners or pressure, wherein the collar is able to prevent a hair particle or a liquid from entering beneath the collar inner edge, and from the liquid soaking through the top and bottom surface of the collar and onto the user's skin and clothing; and, removing the collar after the styling is complete by separating the collar ends, sanitizing the collar with a per sanitization rules and regulations, air or heat drying the collar, and reapplying the collar to a second user.

18. The method of using a re-useable haircutting collar of claim 17, wherein a thickness of the collar is constant, and/or increasing, along a collar width spanning from the inner edge to the outer edge on the collar top surface, and ranging from about one to three millimeters thickness.

19. The method of using the re-useable haircutting collar of claim 17, wherein the collar comprises platinum cured silicone of Shore 2A, and the collar is colored or non-colored translucent, or colored or non-colored opaque.

20. The method of using the re-useable haircutting collar of claim 18, wherein the collar thickness on the collar top surface increases at a constant rate from about one millimeter at the collar inner edge to about three millimeters at mid-section, and the thickness is about three millimeters from the mid-section to the outer edge; and wherein the mid-section is located a distance of about one-third of a collar width from the collar inner edge.

* * * * *